United States Patent [19]

Andrews Jr.

[11] Patent Number: 4,869,672

[45] Date of Patent: Sep. 26, 1989

[54] DUAL PURPOSE CARD EDGE CONNECTOR

[75] Inventor: Howard W. Andrews Jr., Hershey, Pa.

[73] Assignee: AMP Incorporated, Harrisburg, Pa.

[21] Appl. No.: 339,910

[22] Filed: Apr. 17, 1989

Related U.S. Application Data

[63] Continuation of Ser. No. 267,199, Nov. 4, 1988, abandoned.

[51] Int. Cl.[4] ..... H01R 9/09

[52] U.S. Cl. ..... 439/60; 439/630; 439/636

[58] Field of Search ..... 439/60–62, 439/64, 630, 633, 636, 637

[56] References Cited

U.S. PATENT DOCUMENTS

| | | | |
|---|---|---|---|
| 4,095,866 | 6/1978 | Merrill | 439/60 |
| 4,298,237 | 11/1981 | Griffith et al. | 439/60 |
| 4,684,194 | 8/1987 | Jenkins | 439/636 |
| 4,705,338 | 11/1987 | Sitzler | 439/630 |
| 4,720,156 | 1/1988 | Beers | 439/630 |
| 4,806,103 | 2/1989 | Kniese et al. | 439/60 |

*Primary Examiner*—P. Austin Bradley

*Attorney, Agent, or Firm*—Allan B. Osborne

[57] ABSTRACT

A dual purpose card edge connector which can accept a printed circuit card having conductive pads on one center-line spacing or another printed circuit card having conductive pads on a different center-line spacing. More particularly, contact portions on contact elements disposed in an insulating housing are alternatively located at two different levels to cooperate with positioning members in the card receiving slot so that a circuit card not having edge notches is positioned on the positioning members and the conductive pads are engaged by the contact portions at the upper level while a circuit card having edge notches slide past the positioning members and the conductive pads thereon is engaged by the contact portions at both levels.

20 Claims, 5 Drawing Sheets

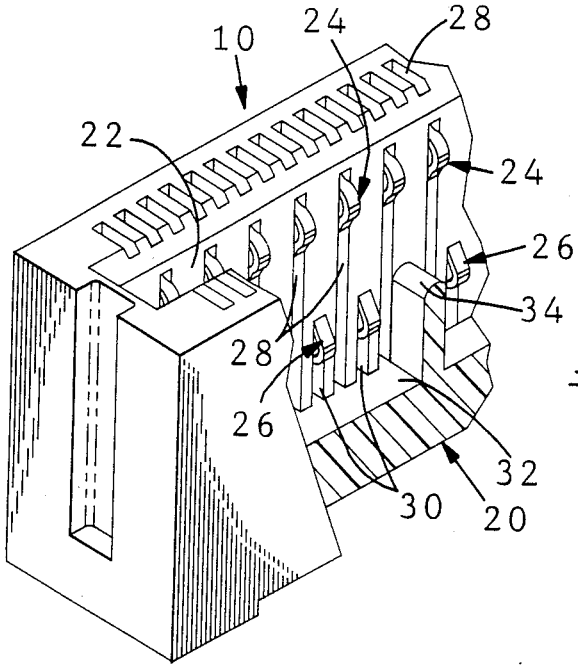
Fig. 2
Fig. 3
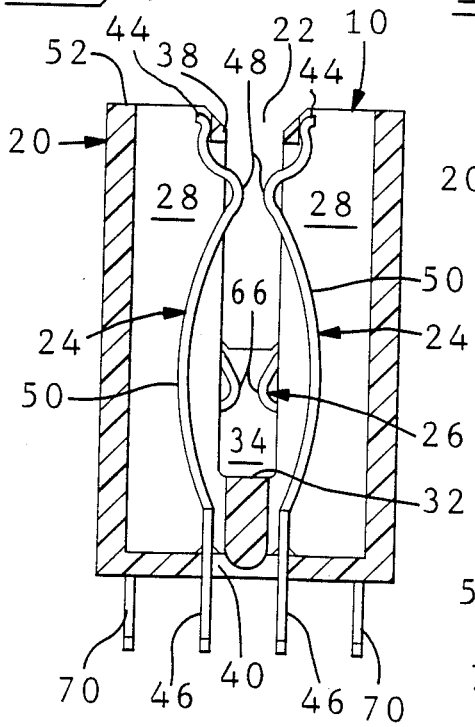
Fig. 4
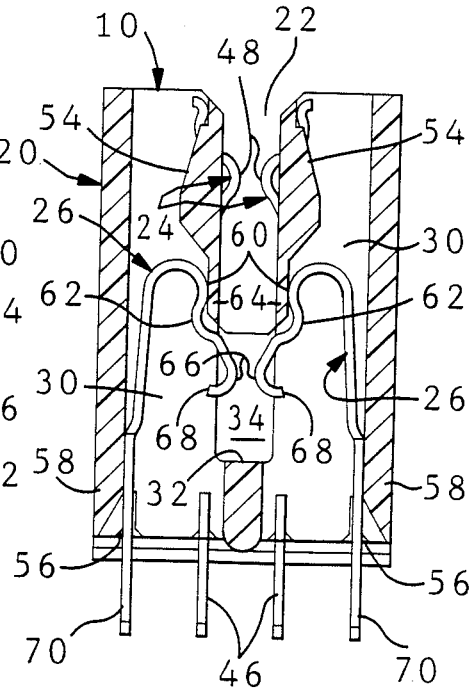

DUAL PURPOSE CARD EDGE CONNECTOR

This application is a continuation of application Ser. No. 07/267,199, filed Nov. 4, 1988, now abandoned.

FIELD OF THE INVENTION

The invention disclosed herein relates to card edge connectors for electrically connecting circuits on a printed circuit card to circuits on a printed circuit board or back plane.

BACKGROUND OF THE INVENTION

Known card edge connectors; e.g., U.S. Pat. No. 4,636,021, are constructed to receive circuit cards having conductive traces or pads on a given center-line spacing; e.g., 0.050 inches between adjacent pads. Thus, a card having a different spacing could not be accepted therein. This means that if a user wanted to use a new circuit card having a different pad spacing, he would have to remove the first card edge connector (a difficult, time consuming task) and install a second connector which would accept the new card.

Therefore, it is now proposed to provide a card edge connector which will accept one or another card each having a different conductive pad spacing.

SUMMARY OF THE INVENTION

According to the invention, a dual purpose card edge connector is provided which can receive either one of two different printed circuit cards having conductive pads on different center-line spacing. The connector includes a dielectric housing having a card receiving slot and conductive contact elements disposed therein with contact portions thereon alternatingly projecting into the slot at high and low levels. Further, positioning members are provided in the slot to position one circuit card so that only the contact portions at the high level engage conductive pads thereon and to position a different circuit card so that the contact portions at both levels will engage conductive pads thereon.

BRIEF DESCRIPTION OF THE DRAWINGS

FIG. 2 is a cut-away view of the connector to show the details with regard to the contact elements contained therein;

FIGS. 3 and 4 are end cross-sectional views of the connector showing details of the cavities and contact elements positioned therein;

DESCRIPTION OF THE INVENTION

Figure 1:
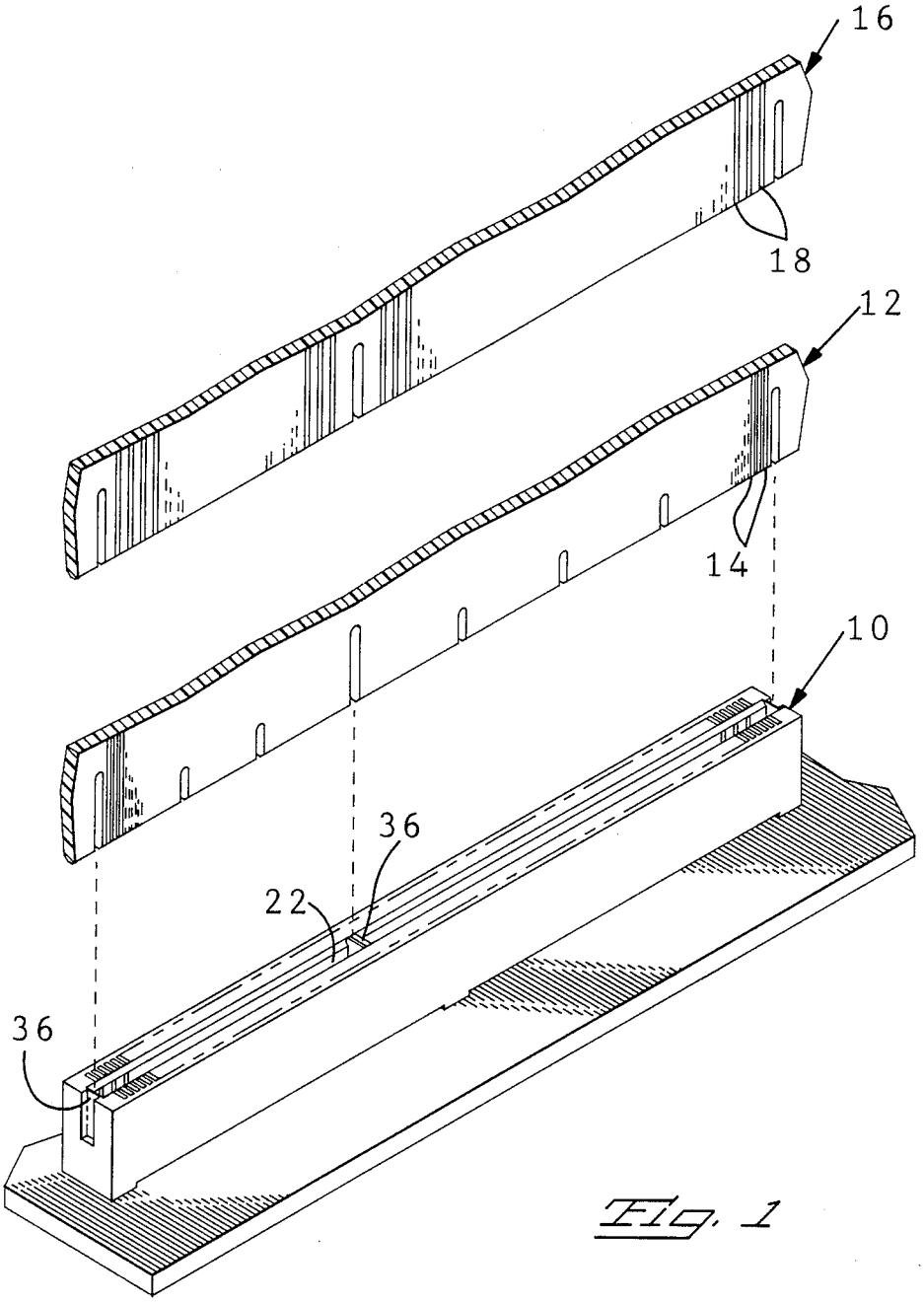
FIG. 1 is a perspective view of an electrical connector constructed in accordance with one embodiment of the present invention and also of two printed circuit cards which may be inserted into the connector for electrical engagement notwithstanding the fact that the conductive pads thereon are on different center-line spacing.

With reference to FIG. 1, card edge connector 10, constructed in accordance with the present invention, is capable of receiving either printed circuit card 12, having closely-spaced conductive pads 14; e.g., pads 14 being on 0.050 inch center-line spacing, or card 16 having pads 18 on a less-dense spacing; e.g., 0.100 inches.

Connector 10, as more clearly shown in FIG. 2, includes an elongated, dielectric housing 20 having a card-edge receiving slot 22 and a plurality of conductive contact elements 24, 26. Contact elements 24, 26 are respectively located in cavities 28, 30 which preferably border both sides of slot 22 and which open thereinto. As shown, cavities 28 alternate with cavities 30. Spaced along floor 32 of slot 22 and extending upwardly therefrom are positioning members 34 (only one is shown in FIG. 2). Additionally, transverse keying walls 36 (FIGS. 1 and 5) are provided in slot 22 to insure that cards 12 and 16 are inserted thereinto in the proper orientation and registration.

With reference to FIG. 3, cavities 28 include preloading bar 38 extending thereacross adjacent the top thereof. Further, passages 40, located near the center of housing 20, extends therethrough, opening into cavities 28 and onto the housing's bottom surface 42. Contacts 24 are positioned in cavities 28 with free ends 44 bearing against bar 38 and leads 46 extending outwardly from surface 42 of housing 20 through passages 40. Further, contact portions 48 on resilient beams 50 project into slot 22 near top surface 52 of housing 20.

With reference to FIG. 4, cavities 30 open only into the lower half of slot 22 with walls 54 closing off access to the upper half. Passages 56, adjacent side walls 58, extend through housing 20, opening into cavities 30 and onto bottom surface 42. Contacts 26 are positioned in cavities 30 with an upper portion 60 on reversely bent resilient beams 62 being preloaded by free ends 64 of walls 54 and contact portions 66 adjacent free ends 68 of beams 62 projecting into the lower half of slot 22; i.e., below walls 54. Leads 70 extend outwardly from surface 42 of housing 20 through passages 56.

From the foregoing description and FIGS. 2–4, it is clear that contact portions 48 on elements 24, alternating with contact portions 66 on elements 26, project into the upper half or upper level of slot 22 while contact portions 66 project into the lower half or lower level of slot 22.

Both contact elements 24, 26 are stamped and formed from a suitable conductive material; e.g., beryllium copper or phosphor bronze.

Figure 5:
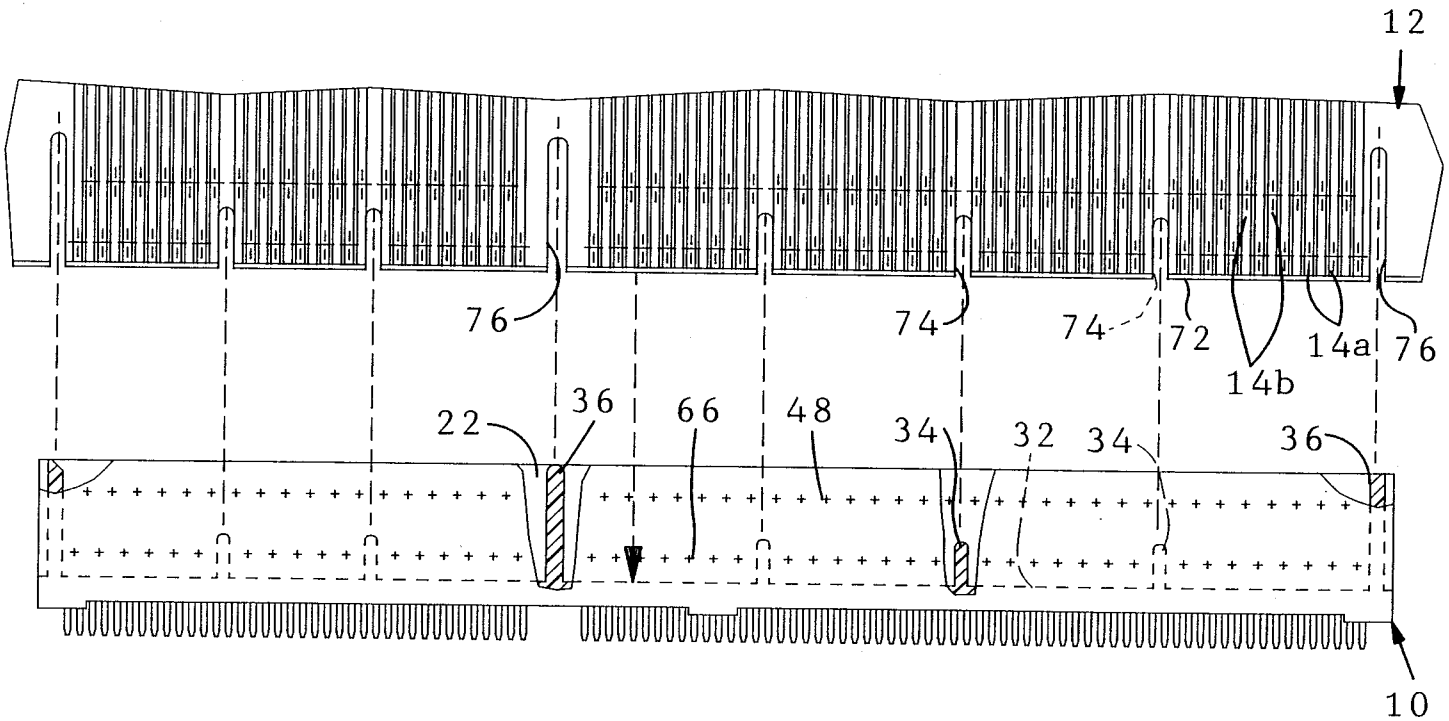
FIG. 5 is a side view of the connector with portions cut away and one of the two circuit cards which may be inserted therein.
Figure 6:
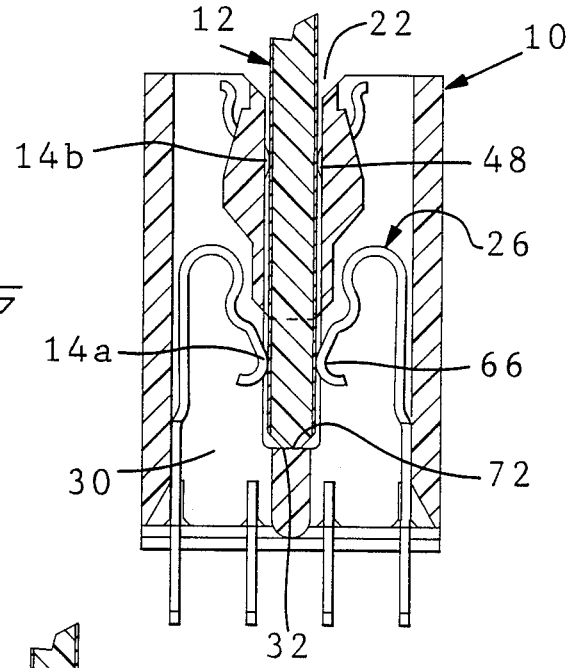
FIG. 6 is an end view of the connector with one of the two circuit cards inserted therein.

FIG. 5 shows card 12 positioned above connector 10. Pads 14 include pads **14*a* which are adjacent card edge 72 and pads 14*b* which are located interiorly from edge 72. Further spaced notches 74 are provided in edge 72 with the spacing of positioning members 34 in slot 22. Keying notches 76 are provided to cooperate with keying walls 36. As card 12 is inserted into slot 22, notches 74 receive positioning members 34 so that card edge 72 abuts slot floor 32. Accordingly, and as shown in FIG. 6, contact portions 48 on elements 24 engage pads 14*b* and contact portions 66 engage pads 14*a* adjacent card edge 72; i.e., in the lower half of slot 22**.

Figure 8:
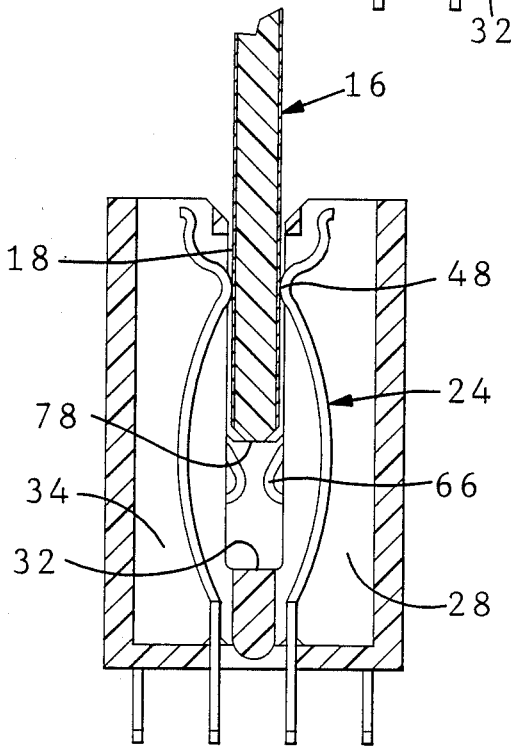
FIG. 8 is an end view of the connector with the other circuit card inserted therein.
Figure 7:
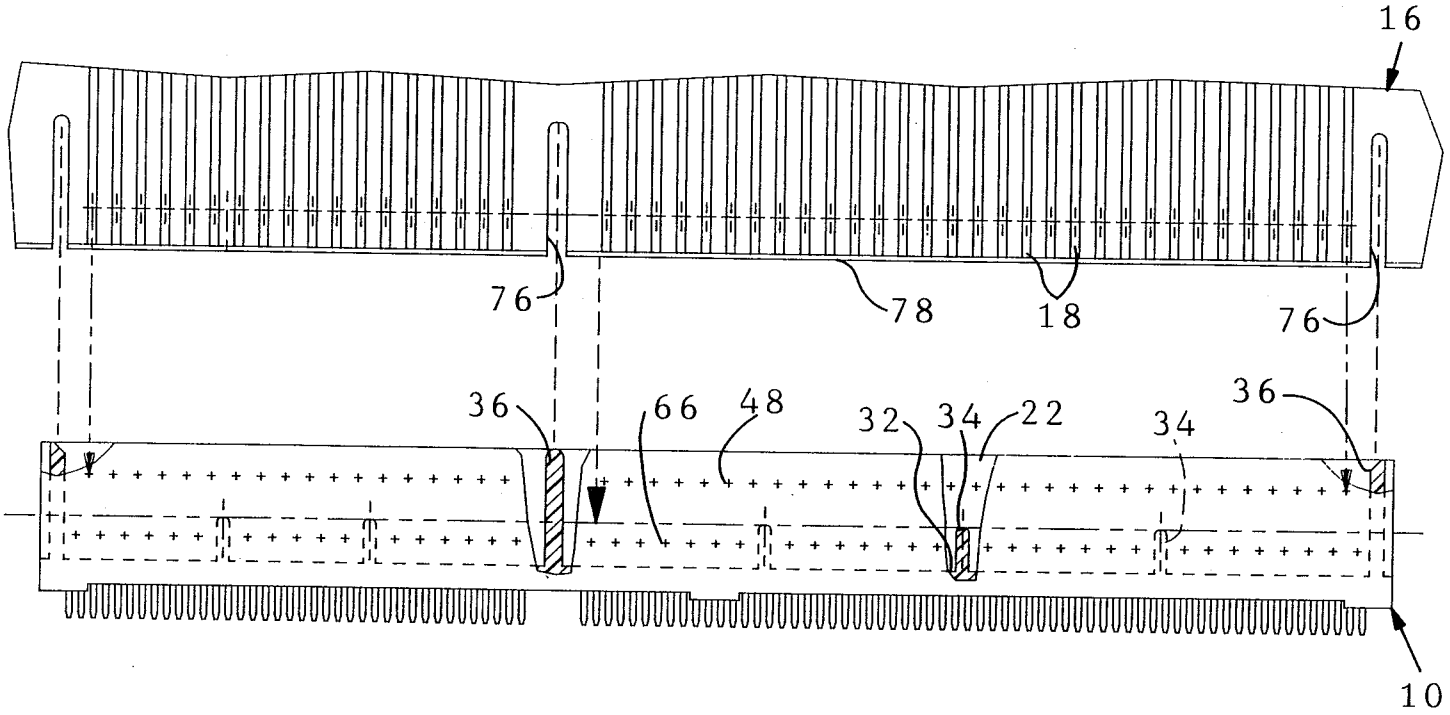
FIG. 7 is the side view of the connector shown in FIG. 5 and with the other of the two circuit cards which may be inserted therein.

FIG. 7 shows card 16 positioned above connector 10. Pads 18 are adjacent card edge 78. Keying notches 76 in edge 78 are provided to cooperate with keying walls 36 in slot 22. As card 16 is inserted into slot 22, edge 78 abuts positioning members 34 to position card 16 in the upper half thereof. Accordingly, as shown in FIG. 8, only contact portions 48 on contact elements 24 engage pads 18 on card 16.

In the illustrated embodiment, positioning members 34 are shown as transverse walls extending upwardly from slot floor 32. However, equivalent positioning members can take other forms; e.g., pins crossing slot 22 at the appropriate height. Further, the profile of slot 22 can be tailored to accept different cards of different thicknesses so that, for example, a thin card would go to the floor while a thicker card would be stopped above the floor.

As can be discerned, a card edge connector has been disclosed which can accept, without modification, printed circuit cards having conductive pads on one center-line spacing or other circuit cards having conductive pads on another center-line spacing. The connector includes conductive contact elements positioned along a card edge-receiving slot and having contact portions thereon projecting into the slot at alternatingly high and low levels. Further, positioning members in the slot cooperate with the cards such that cards having notches along the edge thereof are permitted to slide past the positioning members so that the pads thereon are engaged by the contact portions at both levels. Alternatively, a card without notches is prevented by the positioning members from entering the slot too far so that the conductive pads thereon are engaged only to the upper level contact portions.

I claim:

1. A dual purpose card-edge connector for use with either a first printed circuit card having conductive pads on one center-line spacing or a second printed circuit card having conductive pads on a different center-line spacing, said connector comprising:

an elongated, dielectric housing having an elongated, outwardly open card edge-receiving slot and one or more positioning means in said slot, said positioning means adapted to position the first circuit card at a high level in said slot and to position the second circuit card at a low level in said slot; and conductive contact elements disposed in said housing and extending alongside said slot and having contact portions thereon projecting into said slot at alternatingly high and low levels, said contact portions at said high level adapted to engage conductive pads on either the first or second circuit card which may be inserted into said slot and said contact portions at said low level adapted to engage conductive pads on the second circuit card which may be inserted into said slot.

2. The connector of claim 1 further including polarizing means for cooperating with polarizating means on the first and second printed circuit cards.

3. The connector of claim 1 wherein the second printed circuit card has notches on one edge and said positioning means include transverse walls extending upwardly in said slot and which cooperate with the notches to permit the second printed circuit card to be positioned at the low level.

4. The connector of claim 3 wherein the outwardly facing surfaces of the transverse walls are between the upper and low levels so that the first printed circuit card abuts thereagainst upon being inserted into the slot.

5. A dual purpose card-edge connector for receiving either a first printed circuit card having parallel circuits on one center-line spacing or a second printed circuit card having parallel circuits on different center-line spacing, said connector comprising:

an elongated, insulative housing having an elongated, outwardly open card-edge receiving slot in one surface thereof, and positioning means disposed in said slot for positioning, the first printed circuit card at an upper level in the slot and the second printed circuit card at a lower level in the slot;

a plurality of first conductive contact elements disposed in the housing and having contact portions extending into the slot at the upper level for engaging the circuits on either the first or second printed circuit card which may be inserted thereinto; and a plurality of second conductive contact elements disposed in the housing and having contact portions extending into the slot at the lower level for engaging the circuits on the second printed circuit card which may be inserted therein, said contact portions of said second elements further being longitudinally offset in the slot relative to the contact portions on the first contact elements.

6. A dual purpose card edge connector configured and adapted to mate with both a first card having a plurality of first conductive pads arranged in a first spatial pattern and a second card having a plurality of second conductive pads arranged in a second spatial pattern, different from the first spatial pattern, said connector comprising:

an elongated housing having a card edge receiving slot shaped to receive both the first card and the second card at respective times;

a plurality of first contact elements disposed in the housing to extend alongside the slot and having first contact portions positioned to extend into the slot to contact respective ones of the first conductive pads above a selected level in the slot;

a plurality of second contact elements disposed in the housing to extend alongside the slot and having second contact portions positioned to extend into the slot to contact respective ones of the second conductive pads below the selected level in the slot; and means in the housing for positioning the first card at an upper level in the housing, at which the first contact portions contact the first conductive pads and the second contact portions are isolated from the card and for positioning the second card at a lower level in the housing, at which the second contact portions contact the second conductive pads.

7. The connector of claim 6, wherein the first and second contact portions alternate with one another alongside the slot.

8. The connector of claim 6, wherein the second card has a plurality of third conductive pads arranged in the first spatial pattern, and wherein the first contact portions contact the third conductive pads when the second card is positioned in the slot at the lower level.

9. The connector of claim 8, wherein the first and second contact portions alternate with one another alongside the slot.

10. The connector of claim 6, wherein the positioning means comprises at least one positioning member extending at least partially across the slot.

11. The connector of claim 10, wherein the second card defines at least one recess, each positioned to receive a respective positioning member, and wherein the first card is configured to abut without receiving each positioning member.

12. A card edge connector assembly comprising;

a printed circuit card having an edge and a plurality of first conductive pads arranged in a first spatial pattern at the edge;

an elongated housing having a card receiving slot that receives the card with the first conductive pads at least partially in the slot, said housing comprising means for preventing the card from entering the slot beyond a selected level in the slot;

a plurality of first contact elements disposed in the housing to extend alongside the slot and having first contact portions contacting respective ones of the first conductive pads above the selected level in the slot; and a plurality of second contact elements disposed in the housing to extend alongside the slot and having second contact portions positioned to extend into the slot below the selected level in the slot such that the second contact portions are isolated from all conductive pads on the card, said second contact portions configured to contact additional conductive pads of an additional card shaped to enter the slot beyond the selected level.

13. The connector assembly of claim 12 wherein the first and second contact portions alternate with one another alongside the slot.

14. The connector assembly of claim 12 wherein the preventing means comprises at least one positioning member extending at least partially across the slot and positioned to contact the printed circuit card to prevent the printed circuit card from entering the slot beyond the selected level in the slot.

15. A dual purpose first connector configured and adapted to mate with both a second connector having a plurality of first conductive elements arranged in a first spatial pattern and a third connector having a plurality of second conductive elements arranged in a second spatial pattern, different from the first spatial pattern, said first connector comprising;

an elongated housing shaped to mate with both the second and third connectors at respective times:

a plurality of first contact elements disposed in the housing and having first contact portions positioned to contact respective ones of the first conductive elements above a selected level in the housing;

a plurality of second contact elements disposed in the housing and having second contact portions positioned to contact respective ones of the second conductive elements below the selected level in the housing; and means included in the housing for positioning the second connector at an upper level with respect to the housing, at which the first contact portions contact the first conductive elements and the second contact portions are isolated from the second connector, and for positioning the third connector at a lower level with respect to the housing, at which the second contact portions contact the second conductor elements.

16. The first connector of claim 15 wherein the first and second contact portions alternate with one another.

17. The first connector of claim 15, wherein the third connector has a plurality of third conductive elements arranged in the first spatial pattern, and wherein the first contact portions contact the third conductive elements when the third connector is positioned at the lower level with respect to the housing.

18. The first connector of claim 17, wherein the first and second contact portions alternate with one another.

19. The first connector of claim 15, wherein the positioning means comprises at least one positioning member.

20. The first connector of claim 19, wherein the third connector defines at least one recess, each positioned to receive a respective positioning member, and wherein the second connector is configured to abut without receiving each positioning member.

* * * * *